US011164408B2

(12) United States Patent
Bryla et al.

(10) Patent No.: US 11,164,408 B2
(45) Date of Patent: Nov. 2, 2021

(54) LOCK SYSTEMS AND METHODS

(71) Applicant: Sargent Manufacturing Company, New Haven, CT (US)

(72) Inventors: Mark Bryla, Cumming, GA (US); Michael Lorello, Guilford, CT (US)

(73) Assignee: Sargent Manufacturing Company, New Haven, CT (US)

( * ) Notice: Subject to any disclaimer, the term of this patent is extended or adjusted under 35 U.S.C. 154(b) by 522 days.

(21) Appl. No.: 16/142,606

(22) Filed: Sep. 26, 2018

(65) Prior Publication Data

US 2019/0130684 A1 May 2, 2019

Related U.S. Application Data

(60) Provisional application No. 62/579,362, filed on Oct. 31, 2017.

(51) Int. Cl.
*G07C 9/00* (2020.01)
*E05B 47/00* (2006.01)

(52) U.S. Cl.
CPC .... *G07C 9/00309* (2013.01); *E05B 2047/005* (2013.01); *E05B 2047/0058* (2013.01); *E05B 2047/0072* (2013.01); *E05B 2047/0084* (2013.01); *G07C 9/0069* (2013.01); *G07C 9/00563* (2013.01); *G07C 2009/00373* (2013.01); *G07C 2009/00587* (2013.01); *G07C 2009/00642* (2013.01); *G07C 2009/00793* (2013.01); *G07C 2009/00801* (2013.01)

(58) Field of Classification Search
CPC ..... G07C 9/00309; G07C 9/00563; G07C 2009/00793; G07C 9/0069; G07C 2009/00801; G07C 2009/00373; G07C 2009/00642; G07C 2009/00587; E05B 2047/005; E05B 2047/0072; E05B 2047/0084; E05B 2047/0058
USPC ..... 340/5.51, 5.53; 367/140
See application file for complete search history.

(56) References Cited

U.S. PATENT DOCUMENTS 4,437,497 A * 3/1984 Enander ..... B65B 3/26 137/386
5,872,516 A * 2/1999 Bonge, Jr. ..... A01K 15/023 340/573.3
6,353,732 B1 * 3/2002 Dvorak ..... H04W 36/30 455/67.13

(Continued)

*Primary Examiner* — Nam V Nguyen
(74) *Attorney, Agent, or Firm* — Wolf, Greenfield & Sacks, P.C.

(57) ABSTRACT

Lock systems are disclosed. The lock system may include a lock unit and a separate base station. The lock unit may include one or more components maintained in a powered-off and/or low-power standby state when not in use. The lock unit may include a sound receiver. The lock unit may activate power to one or more components unit after detecting a predetermined activation sound transmitted by a sound transmitter on the base station. The lock unit and base station may include wireless communicators to communicate signals and/or information between the lock unit and base station after the lock unit is powered on. To conserve power, a lock unit may power down after a predetermined action has been completed, communication of a power down signal, and/or after a predetermined time period has elapsed.

21 Claims, 3 Drawing Sheets

(56) References Cited

U.S. PATENT DOCUMENTS 6,366,651 B1 * 4/2002 Griffith ..... H04M 1/7243 379/88.14
6,397,186 B1 * 5/2002 Bush ..... G06F 3/167 704/274
7,080,014 B2 * 7/2006 Bush ..... G06F 3/167 704/275
7,127,083 B2 10/2006 Han et al.
7,132,925 B2 * 11/2006 Johnson ..... E05B 43/005 340/5.73
7,158,499 B2 * 1/2007 Anderson ..... H04B 1/46 370/338
7,260,221 B1 * 8/2007 Atsmon ..... H04M 1/2155 380/247
8,224,286 B2 * 7/2012 Sinivaara ..... G10L 25/78 455/404.1
8,872,915 B1 10/2014 Scalisi et al.
8,947,203 B2 * 2/2015 Kolar ..... B60R 25/257 340/5.72
9,049,352 B2 6/2015 Scalisi et al.
9,372,111 B2 * 6/2016 Hall ..... G01H 5/00
9,574,372 B2 * 2/2017 Johnson ..... E05B 47/02
9,769,435 B2 9/2017 Scalisi et al.
10,102,702 B1 * 10/2018 Wheeler ..... G06F 3/167
2003/0222758 A1 * 12/2003 Willats ..... B60R 25/24 340/5.72
2004/0198382 A1 * 10/2004 Wong ..... H04B 1/385 455/456.1
2008/0296926 A1 * 12/2008 Hanzel ..... H03K 17/941 296/146.1
2009/0140878 A1 * 6/2009 Ryan, II ..... B60R 25/00 340/4.37
2012/0280790 A1 * 11/2012 Gerhardt ..... G07C 9/00571 340/5.61
2014/0169139 A1 * 6/2014 Lee ..... G08C 17/00 367/197
2014/0354820 A1 12/2014 Danialian et al.
2015/0156031 A1 6/2015 Fadell et al.
2015/0333572 A1 * 11/2015 Leabman ..... H04W 52/38 320/108
2016/0266655 A1 * 9/2016 Heyl ..... G06F 1/1694
2017/0178437 A1 * 6/2017 Ribas ..... G07C 9/00817
2017/0318142 A1 * 11/2017 Skjoldborg ..... H04W 76/14
2018/0037194 A1 * 2/2018 Senzaki ..... B60R 25/257
2019/0043295 A1 * 2/2019 Liang ..... G07C 9/37
2019/0311715 A1 * 10/2019 Pfeffinger ..... G06F 3/167

* cited by examiner

LOCK SYSTEMS AND METHODS

RELATED APPLICATIONS

This Application claims the benefit under 35 USC 119(e) of U.S. Application Ser. No. 62/579,362, filed Oct. 31, 2017, titled "LOCK SYSTEMS AND METHODS", which is hereby incorporated by reference in its entirety.

FIELD

Disclosed embodiments are related to lock systems and their methods of operation.

BACKGROUND

Locks for entryways such as doors often include a locking component such as a deadbolt or latch that is movable between an unlocked position to permit opening of the door, and a locked position to lock the door in a closed position. Some lock systems may include one or more electrical components, such as electrically driven lock motors to move the locking component between the locked and unlocked positions.

SUMMARY

In one embodiment, a lock system includes a lock movable between a locked position and an unlocked position, an actuator coupled to the lock to move the lock between the locked position and the unlocked position and a sound receiver associated with the actuator. Power to the actuator is activated when the sound receiver detects a predetermined sound.

In another embodiment, a lock system includes a lock unit including a lock moveable between a locked position and an unlocked position, an actuator coupled to the lock to move the lock between the locked position and the unlocked position, a sound receiver, a first wireless communicator, and a lock unit controller operatively coupled with the actuator, sound receiver, and the first wireless communicator. The lock system further comprises a base station spaced from the lock unit. The base station includes a sound transmitter, a second wireless communicator, and a base station controller operatively coupled with the sound transmitter and second wireless communicator.

In yet another embodiment, a method of operating a lock system includes transmitting a predetermined sound from a base station of a lock system. The lock system includes the base station and a lock unit spaced from the base station. The method further includes detecting the predetermined sound with a sound receiver on the lock unit, and activating power to one or more components of the lock unit after detecting the predetermined sound with the sound receiver.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
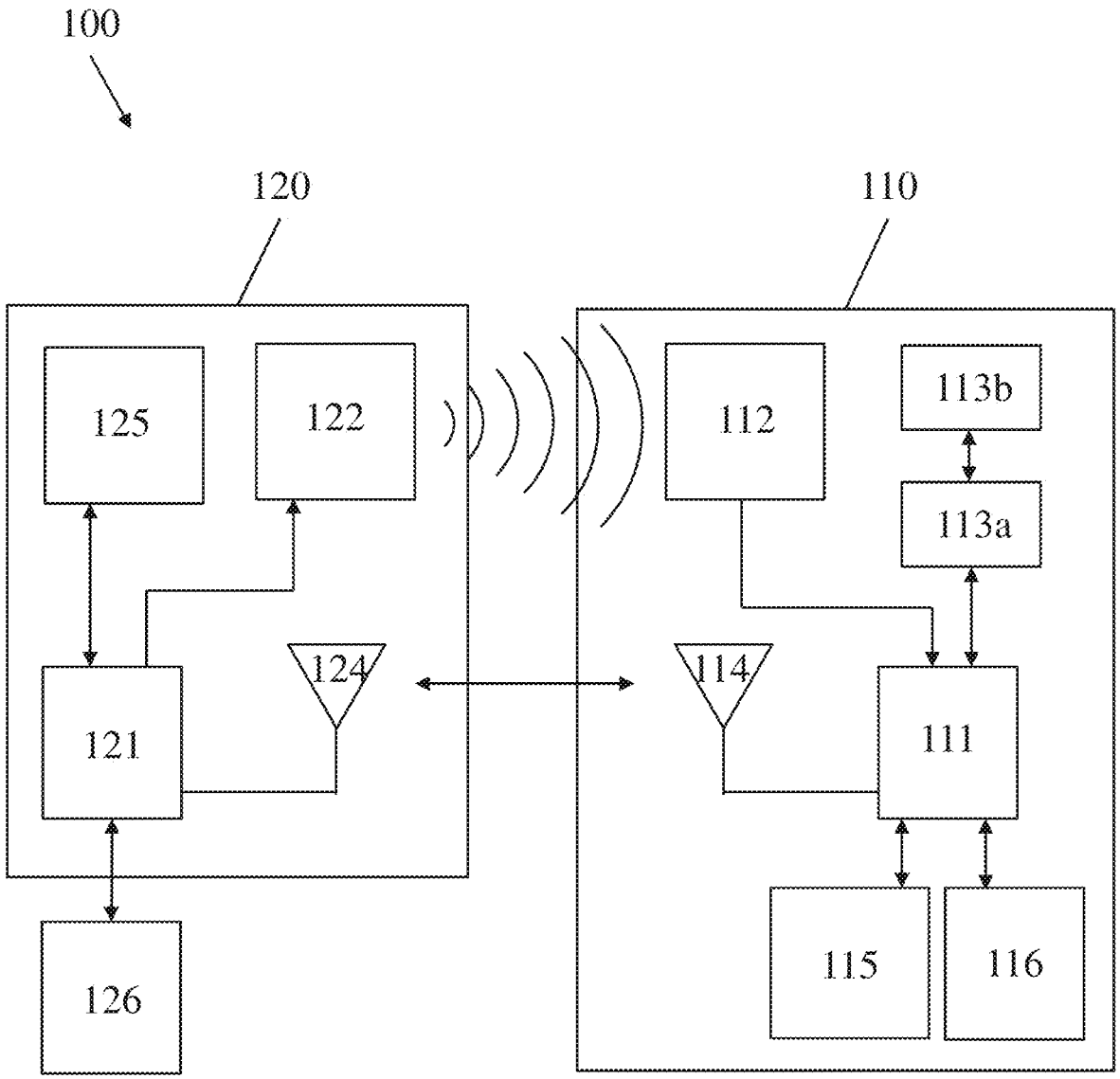
FIG. 1 is a schematic representation of a lock system according to one embodiment.

The inventors have appreciated that entryways such as doors, gates, garages, windows, and other access regions may include electronic lock systems, which in some instances, may provide for enhanced convenience and/or security compared to conventional locks. However, the various components of electric lock systems, such as a radio frequency identification (RFID) or other near-field communication reader, a wireless communication device, a lock motor, a keypad, and/or other appropriate components use electrical power. Further, in some cases, such components may always be in a powered-on state. For example, a component such as an RFID reader may always be powered on an awaiting a signal, such as an unlock signal or code from a corresponding RFID device and/or remote keypad.

The inventors have also appreciated that in some instances, components such as RFID readers and/or associated wireless communication devices, which are always powered-on and awaiting a signal (e.g., an unlock signal), may be among the largest power draws in a system. For example, an RFID reader on a lock may need to constantly emit a signal such that when a corresponding RFID device is brought into proximity with the RFID reader, the reader can detect a signal from the device. Similarly, a wireless communication device may need to be constantly powered on and maintained in a listening mode while awaiting a signal such as an unlock signal. Such constant broadcasting and/or listening may lead to significant power usage, and such components may be the primary power draw of the system. In instances where a door lock is powered by a battery, the noted constantly powered components will shorten the battery life of the lock system. Accordingly, many lock systems use large batteries or battery assemblies and/or may need frequent replacement of the batteries to operate in this manner.

In view of the above, the inventors have recognized numerous benefits associated with lock systems that include components that are only powered on when needed. For example, such systems may avoid the need to always maintain components such as RFID readers and/or wireless communication devices in a powered-on state. Instead, one or more components (e.g., RFID readers and/or wireless communication devices) may be maintained in a powered-off or low-power standby state until the components are needed to be powered on, such as to detect an RFID signal, and/or to communicate with other components. After being powered on, the one or more components may be operated for as long as needed, and may subsequently be powered off and/or switched to a low-power standby state until they are later needed to be powered on again.

In some instances, powering the various components of a lock system only when needed may dramatically reduce the overall power usage of the system. This may facilitate the use of smaller batteries compared to lock systems that have constantly powered components. The inventors have appreciated that using smaller batteries and/or battery packs may, in some instances, be beneficial from a packaging perspective in addition to providing enhanced battery life and/or less battery maintenance as well.

Moreover, the inventors have recognized that the lock systems described herein may allow for a distributed placement of various battery operated components, which may allow for easier installation of the lock system, and may provide a simpler mechanical and electrical design. For example, a lock system may include a battery operated lock unit that may be installed on a door (or other suitable entryway), and the lock unit may communicate to a separate control unit located off of the door. In this manner, the lock system may be installed without wiring the lock unit to the separate control unit, and in some instances, may allow the lock units to be installed in existing doors without modification.

In some embodiments, a lock system may be a modular system including two or more intercommunicating units. For example, in one embodiment, a lock system may include a lock unit located on a door (or other suitable entryway), and the lock unit may communicate with a separate base station located off of the door (e.g., adjacent the door). The base station may be constantly powered (e.g., connected to a wired power supply), and therefore the various components of the base station may always be in a powered-on state. However, embodiments in which the base station includes one or more battery operated components are also contemplated. The lock unit may include a sound receiver that is configured to activate power to the lock unit upon receiving a wakeup signal. As described in more detail below, the wake up signal may be a predetermined subsonic and/or ultrasonic sound signal such that the signal is not audible, though in certain embodiments the wakeup sound signal may be an audible sound, as the current disclosure is not limited to any particular wake up signal.

As discussed previously, the inventors have appreciated that it may be beneficial to maintain one or more components of a lock system in a powered-off or low-power standby state until they are needed. Accordingly, in some embodiments, a lock system may include a power activation system including a sound receiver located on a lock unit and a corresponding sound transmitter located on a base station separate from the lock unit. The sound receiver may be constructed and arranged to trigger activation of power to the components of the lock unit after the sound receiver detects a predetermined sound (e.g., an activation sound) transmitted by the sound transmitter. The sound receiver may be coupled to a lock controller on the lock unit, and the sound receiver may activate power to the lock controller after detecting the activation sound. Once the lock controller is powered on, the lock controller may initiate one or more functions, such as initiating communication with a base station via wireless communicators, operating a lock actuator to move a lock between a locked position and an unlocked position, and/or operating one or more sensors associated with the lock unit, as described in more detail below.

Depending on the particular embodiment, a base station may include a sound transmitter (e.g., a speaker) to transmit a predetermined activation sound to an associated lock unit. Additionally, as noted previously, the base station may include a wireless communicator such as an RF, Bluetooth, Wi-Fi, or other suitable wireless communication component to wirelessly communicate with an associated wireless communicator located on the lock unit. Moreover, the base station may include one or more user input and/or output components such as a keypad, RFID reader, and/or other suitable interface to permit desired input to, and/or output from, the base station. For example, a user may input an unlock code on a keypad and/or scan an RFID tag on an associate RFID reader, and such user input may trigger the sound transmitter to send the activation sound to the lock unit to activate power to the lock unit. As noted above, once the lock unit is powered on (e.g., after a sound receiver on the lock unit receives a predetermined activation sound transmitted from an associated sound transmitter on a base station), the lock system may perform one or more functions. For example, as discussed previously, a base station and lock unit may communicate wirelessly to transmit instructions to operate an actuator associated with a lock to move the lock between an unlocked position and a locked position.

In some embodiments, a sound receiver on a lock unit may include one or more microelectromechanical system (MEMS) and/or piezoelectric elements, such as a piezoelectric MEMS microphone. The sound receiver may be constructed and arranged to activate power to one or more components of the lock unit after receiving a wake up signal from a sound transmitter located on a base station separate from the lock unit. In some embodiments, the MEMS and/or piezoelectric element of the sound receiver may be considered a low power sensor. For example, the power to activate the sound receiver may significantly be less than the power to operate components of a lock system such as an RFID reader and/or other wireless communication device. In one exemplary embodiment, the sound receiver includes a Vesper VM1010 MEMS microphone, though other sound receivers also may be suitable.

According to some aspects, intercommunicating units of the lock systems described herein may be arranged in proximity to one another such that communication between the various units, such as transmission of an activation signal and/or wireless communication between the units after activation, occurs over a small spatial distance. For example, in some embodiments, a maximum distance between a lock unit and a base station may less than about 10 meters, 5 meters, 2 meters, 1 meter, or any other appropriate distance. The inventors have appreciated that maintaining a small distance between the intercommunicating components may reduce the power to transmit communications between the components, and in some instances, may reduce the chance of interference from other wirelessly communicating systems. However, it should be understood that the current disclosure is not limited to any particular distance between a lock unit and a base stator or other intercommunicating components of a lock system.

In one embodiment, a lock unit (which may be provided on a door or other suitable entryway) includes a lock that is movable between an unlocked position and a locked position to selectively secure the door. For example, the lock may include a deadbolt, a latch, or any other suitable locking structure to selectively secure the door in a locked configuration and selectively restrict opening of the door, and in certain embodiments, the lock may be received in a corresponding receptacle when in the locked position. However, it should be understood that the current disclosure is not limited to any particular lock structure.

In some embodiments, a lock may be operatively coupled to an actuator (e.g., a lock motor) that may move the lock between the locked and unlocked positions. The actuator may be coupled to a lock controller that controls the operation of the actuator based on signals received by the lock controller. For example, the lock controller may receive an unlock signal and may operate the actuator to move the lock from the locked position to the unlocked position. Similarly, the lock controller may operate the actuator to move the lock from the unlocked position to the locked position after the lock controller receives a lock signal.

As noted above, a lock controller of a lock unit may communicate with a separate base station controller spaced from the lock unit. Accordingly, a lock unit may include a first wireless communicator arranged to wirelessly communicate with a second wireless communicator located on a base station spaced from the lock unit. Depending on the particular embodiment, the first and second wireless communicators may communicate with each other via radio frequency (RF) communication, Bluetooth, Wi-Fi, or any other suitable wireless communication protocol. As described in more detail below, communication between the first and second wireless communicators may be used to perform one or more functions, such as sending a lock and/or unlock signal communicating a state of the lock (e.g., whether the lock is in the locked or unlocked position) to the base station, and/or updating software and/or firmware on the lock unit.

In some embodiments, a lock system may include one or more user input components that a user may interface with to operate the lock system. In some instances, the user input components may be the components of a lock system with the largest power usage, and therefore, the user input components may be located on a base station that may have a constant power supply (e.g., a wired power source). For example, the user input components may include a keypad, an RFID reader, or other suitable components that a user may interact with to control operation of the lock. For example, a user may enter an unlock code via a keypad or by scanning an RFID tag on an RFID reader, and after authenticating the unlock code, wireless communication between various lock components may be activated such that instructions may be transmitted between a base station and a lock unit. For example, the base station may transmit an activation sound to the lock unit to activate power to the lock unit after a user entered code is authenticated, and the base station may subsequently communicate with the lock unit as described above to perform a desired function, such as moving the lock between the locked and unlocked positions.

According to some embodiments, a sound receiver of a power activation system may include a piezoelectric MEMS microphone that is constructed and arranged to activate power to the various components of a lock unit after detecting a predetermined activation sound. As discussed previously, prior to activation by the sound receiver, one or more components of the lock system may be maintained in a powered-off or low-power standby state. Once the sound receiver detects the predetermined activation sound, the sound receiver may send an activation signal that activates power to one or more other components of the lock unit, such as the lock controller, actuator, wireless communicator, one or more sensors, and so on.

As discussed above, a sound transmitter on a base station may transmit a predetermined activation sound to a sound receiver on a lock unit to trigger activation of power to the lock unit. In some embodiments, the predetermined activation sound may be a subsonic or ultrasonic sound, such that the activation sound is not audible to users of the lock system. However, an audible activation sound may be suitable in some embodiments. Depending on the particular embodiment, the predetermined activation sound may include one or more sound pulses, such as pulses of one or more frequencies, amplitudes, and/or pulse durations. Moreover, in some embodiments, the predetermined activation signal may include information encoded in the sound, for example, by modulating the frequency, duration, and/or amplitude of one or more pulses of the sound signal. In some instances, an encoded activation sound may be used to selectively activate different components of a lock unit, such as a wireless communicator (e.g., to initiate a software and/or firmware update) or lock the actuator without activating power to the entire lock unit.

In addition to the above, in some embodiments, an encoded activation sound may be desirable to provide increased security to a lock system. For example, different lock system may use unique encoded activation sounds in order to prevent the possibility of inadvertent activation of power to a lock unit of one lock system based on the transmission of an activation sound from a base station of a different lock system.

In some instances, communication between a lock unit and a base station may be used to audit the state of the door. Correspondingly, a lock unit may also communicate information such as a position of the lock (e.g., locked or unlocked), how long the door and/or lock has been in a particular state, the charge level of a battery on the lock unit, and so on. In one embodiment, auditing the state of the door may include communicating if the door is open or closed, how long the door has been open or closed, number of access attempts within a particular time period, and/or if the door was not closed since a previous activation of the lock unit. In some embodiments, a lock system may have an access list which includes access codes and/or identification codes associated with different users that may be permitted to unlock the lock. In some such embodiments, communication between the lock unit and base station after the lock unit is powered on may be used to update the access list.

In addition to the above, in some embodiments, a lock unit may include a memory that is updated (e.g., via wireless communication with the base station) after the lock unit is powered on. For example, updating the memory may include updating software and/or firmware on the lock unit. In one embodiment, a lock unit may only attempt to perform a software and/or firmware update when woken up (i.e., powered on after being maintained in a powered-off or low-power standby state). For instance, a lock controller may be woken up after receiving an activation signal from a sound receiver, as discussed above. Subsequently, the lock controller may initiate a wireless communication with an associated base station to query if an update is available. If an update is available, the update may be wirelessly transmitted from the base station to the lock controller, and the memory on the lock unit may be updated. According to some aspects, checking for updates only when the lock unit is woken up may allow the system to save on power, for example, compared to a system in which the lock unit is always checking for updates or is checking for updates at predetermined times or time intervals.

In some instances, once one or more desired functions of a lock system are completed, one or more components of a lock unit of the system may be powered off and/or placed in a low-power standby state. For example, in one embodiment, a base station may send a deactivation signal to a lock unit to cause the lock unit to revert to a powered-off or low-power standby state. Subsequently, the base station may terminate the communication with the lock unit. In another embodiment, the lock unit may be deactivated after an expected communication sequence between the lock unit and the base station has finished. For example, the lock unit may deactivate after a software update communication is finished. In yet another embodiment, the lock unit may power down and/or enter a low-power standby mode after a predetermined period of time has elapsed after activating the lock unit, such as an expected amount of time to perform one or more desired functions. For example, the expected amount of time may be just an amount of time to complete a communicated task (e.g., to communicate a software update), and/or an amount of time associated with a user operating the door, such as reclosing and/or relocking the door after a user unlocks the door.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 is a schematic representation of one embodiment of a lock system 100 including a lock unit 110, which may be located on a door or other suitable entryway, and a separate base station 120. The lock unit 110 includes a controller 111, coupled to a sound receiver 112, a lock actuator 113*a*, and a first wireless communicator 114. As discussed previously, the sound receiver 112 may include a piezoelectric MEMS microphone or other suitable system to detect a predetermined activation sound transmitted from a sound transmitter 122 located on the base station 120. When the sound receiver 112 detects the predetermined activation sound, the sound receiver may send a signal to the lock controller 111 to activate power to one or more components of the lock unit 110, for example, by activating a low power wakeup circuit on the lock controller 111 or other similar component/control circuit to control power to the one or more components of the lock unit 110.

Activation of power to one or more components of the lock unit 110 may include activating power to the lock controller 111, the first wireless communicator 114, and/or the lock actuator 113*a*. The lock unit may then communicate with the base station 120 via communication between the first wireless communicator 114 on the lock unit 110 and a second wireless communicator 124 on the base station 120. As discussed above, the first and second wireless communicators 114 and 124 may communicate via RF, Bluetooth, Wi-Fi, or any other suitable wireless communication protocol. In some embodiments, a base station controller 121 may operate the second wireless communicator 124 to send signals to the first wireless communicator 114 such that the lock unit 110 performs one or more desired functions. For instance, the base station may transmit a lock or unlock signal via the wireless communicators. After the signal is received by the lock unit, the lock controller 111 may operate the lock actuator 113*a* to move a lock 113*b* between a locked position and unlocked position as desired. In some cases, the base station 120 may transmit information such as an updated access list and/or a software or firmware update to the lock unit 110 via the first and second wireless communicators 114 and 124, and such information may be stored and/or updated on a memory of the lock controller 111.

In some embodiments, an activation signal may be sent in response to a number of situations, including, but not limited to, input from a user, a signal broadcast from a base station, and/or a signal broadcast from a central control separate from the lock unit and base station. For example, in one embodiment, the base station controller 121 and second wireless communicator 124 may send a signal to the lock unit based on a user input from a first user input device 125 located on the base station, such as a keypad, touch pad, fingerprint or other biometric scanner, and/or an RFID reader or other suitable wireless communication device. Alternatively or additionally, the lock unit 110 may include a second user input device 115 coupled to the lock controller to allow a user to provide input (e.g., an unlock code) directly on the lock unit 110. In some instances, the user input may be used to authorize entry for a particular user. For example, the user may enter a code on a keypad, scan a badge on an RFID reader, and/or interact with a biometric scanner to provide an access code to the system. If the access code is authenticated, an activation signal may be sent to the lock unit to activate power to the one or more components of the lock unit. Subsequently, one or more functions may be performed as discussed previously, such as unlocking and/or locking the lock unit.

In some embodiments, the base station controller may be operatively coupled to a power source 126 that provides power to the base station. For example, the power source 126 may include a hard wired power connection to a separate power system, one or more batteries and/or battery packs such as primary and/or secondary batteries, an energy harvesting system, and/or any suitable combinations of the above noted power sources.

Figure 2:
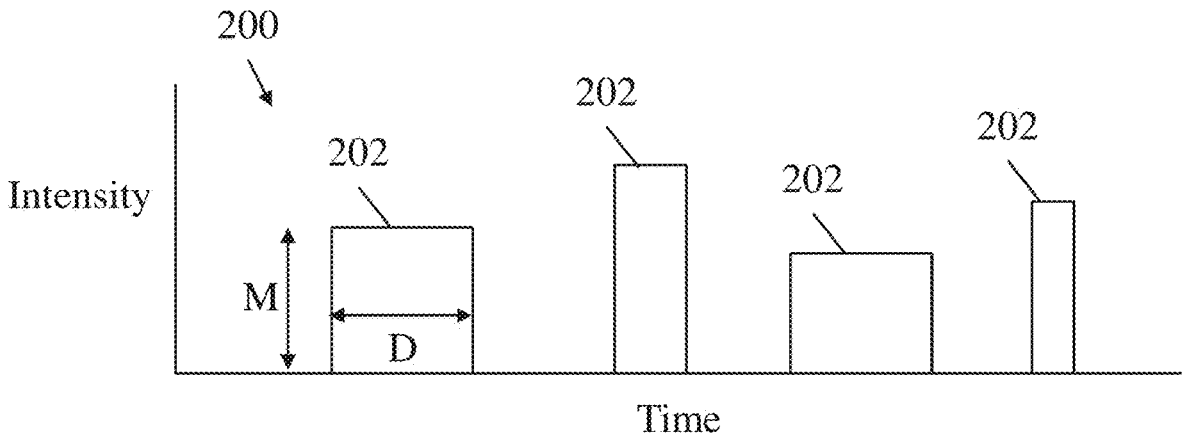
FIG. 2 is a schematic representation of a portion of an activation sound according to one embodiment.
Figure 3:
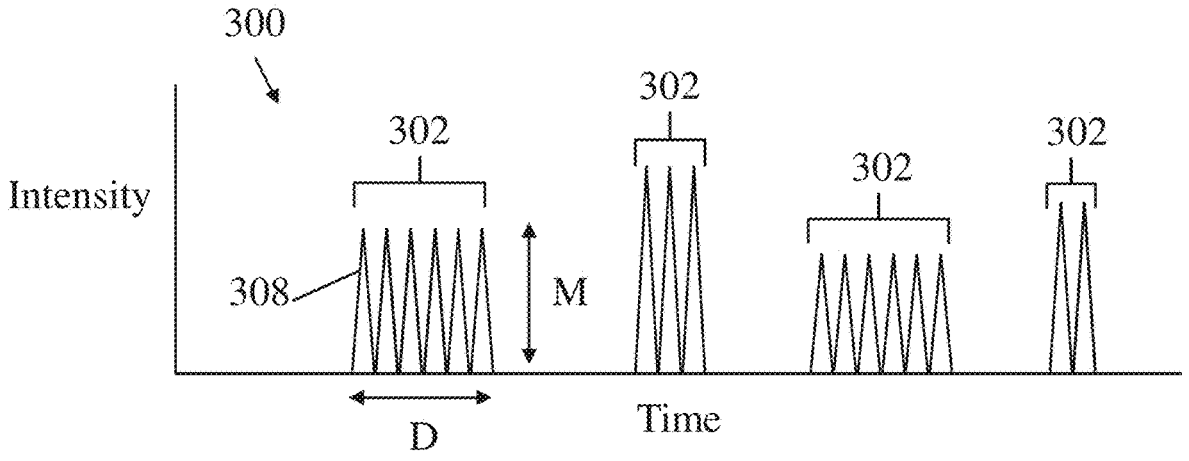
FIG. 3 is a schematic representation of a portion of an activation sound according to another embodiment.

Referring now to FIGS. 2-3, activation sounds that may be used to activate power to one or more components of a lock unit are described in more detail. In particular, FIG. 2 depicts a schematic representation of a portion of an activation sound 200 according to one embodiment. The activation sound 200 may include one or more, or a plurality of, sound pulses 202. As illustrated in FIG. 2, the sound pulses may have different durations D (illustrated by a width of the pulses 202) and/or magnitudes M (illustrated by a height of the pulses 202).

FIG. 3 depicts a schematic representation of a portion of an activation sound 300 according to another embodiment. Similar to the embodiment discussed above in connection with FIG. 2, the activation sound 300 may include one or more, or a plurality of, sound pulses 302, which have a duration D and a magnitude M. In the embodiment shown in FIG. 3, each of the sound pulses 302 includes a plurality of sub-pulses 308. The pulses 302 and/or sub-pulses 308 may be arranged to encode a signal in the activation sound as discussed above. Moreover, it should be understood that different signal pulses 302 may have sub pulses with durations, frequencies, and/or magnitudes that vary within a single sound pulse to encode a desired signal in the activation sound.

It should be understood that the current disclosure is not limited to any particular waveform for an activation sound. For instance, while the activation sound 200 is depicted as a square wave of sound intensity versus time in FIG. 2, other waveforms may be suitable, such as sinusoidal waves, saw tooth waves, and so on. Additionally, although, the signal pulses are depicted as having different magnitudes and durations in FIGS. 2 and 3, in some embodiments, the signal pulses may have the same duration and/or magnitude. Similarly, depending on the particular embodiment, different sound pulses may have the same frequency or different frequencies. Moreover, in some embodiments, the spacing, duration, magnitude, and/or frequency of the pulses may be modulated to encode a signal in the activation code, as discussed above.

Figure 4:
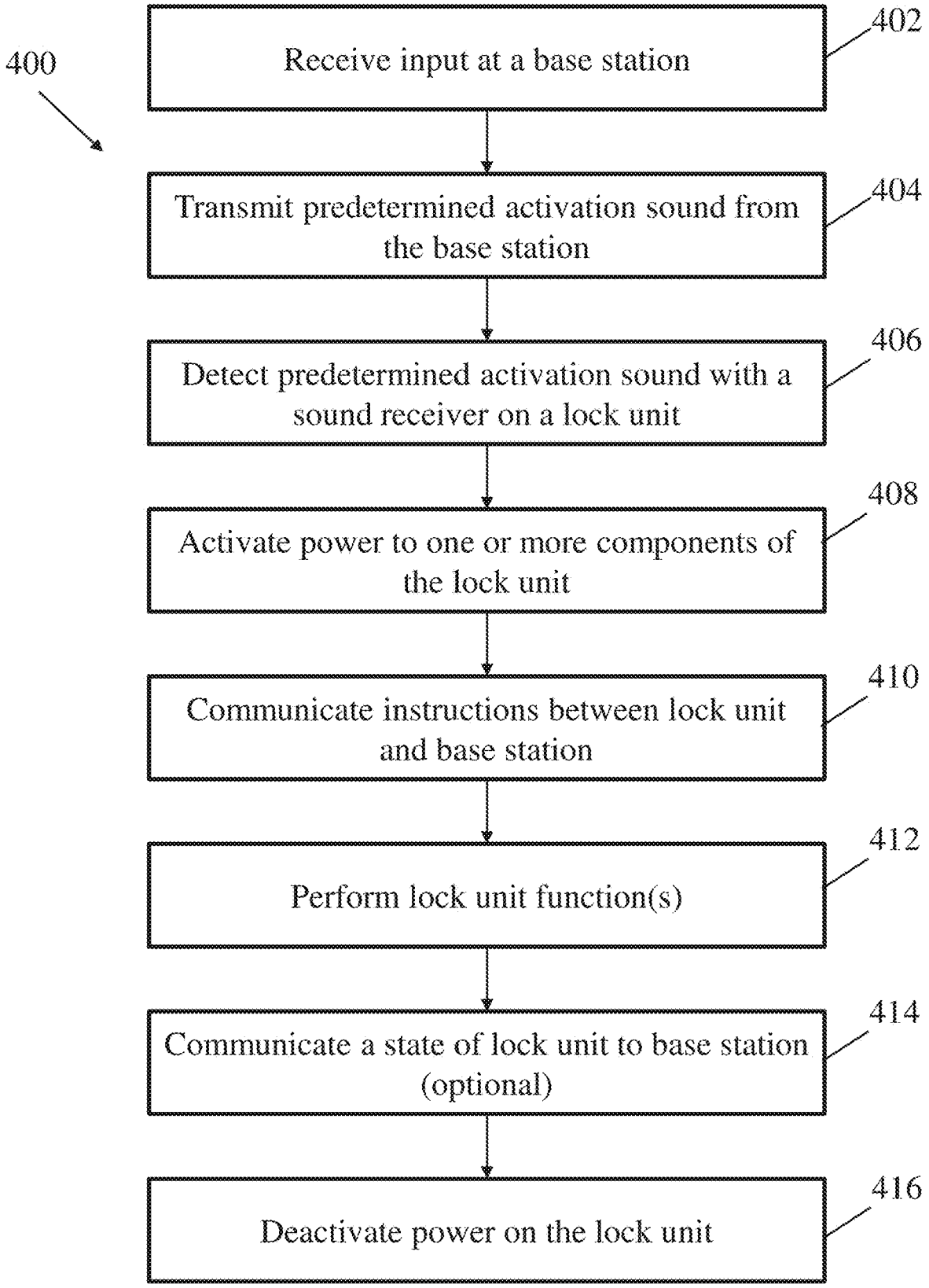
FIG. 4 is a flow chart depicting a method of operating a lock system according to one embodiment.

FIG. 4 is a flow chart depicting an exemplary embodiment of a method 400 of operating a lock system. An input is received at the base station at step 402. For example, the input may include a user input such as an access code entered on a keypad or by scanning an RFID badge, and/or a signal generated by a controller on the base station or broadcast to the base station by a central control system. At step 404, a predetermined activation sound is transmitted from a sound transmitter of the base station of the lock system. As discussed previously, the activation sound may be encoded to send a desired signal. The predetermined activation sound is detected with a sound receiver on a lock unit of the lock system at step 406, and power is activated to one or more of, and in some embodiments, all of, the components of the lock unit at step 408 after detecting the activation sound. Once power to the one or more components of the lock unit is activated, instructions are communicated between the lock unit and the base station at step 410. For example, the instructions can include a lock and/or unlock command, instructions to communicate a state of the lock unit, and/or instructions to perform a software or firmware update. The lock unit then performs one or more desired functions at step 412 based on the instructions communicated between the lock unit and base station. After the desired lock unit functions are completed, the method may optionally include communicating a state of the lock unit to the base station at 414. Subsequently, power to the one or more components of the lock unit is deactivated at step 416 after a desired action has been completed and/or after a predetermined time period. For example, a lock actuator, wireless communicator, and/or lock controller on the lock unit may be powered off or moved into to a low-power standby state.

The above-described embodiments of the technology described herein may be implemented in any of numerous ways. For example, the embodiments may be implemented using hardware, software or a combination thereof. When implemented in software, the software code can be executed on any suitable processor or collection of processors, whether provided in a single computing device or distributed among multiple computing devices. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Also, a computing device may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards or keypads, and pointing devices, such as mice, touch pads, digitizing tablets, RFID readers, magnetic strip readers, biometric scanners, or other appropriate types of input devices. As another example, a computing device may receive input information through speech recognition or in other audible format.

Such computing devices may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the embodiments described herein may be embodied as a computer readable storage medium (or multiple computer readable media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computers or other processors to implement various aspects of the present disclosure as discussed above. As used herein, the term "computer-readable storage medium" encompasses only a non-transitory computer-readable medium that can be considered to be a manufacture (i.e., article of manufacture) or a machine. Alternatively or additionally, the disclosure may be embodied as a computer readable medium other than a computer-readable storage medium, such as a propagating signal.

The terms "program" or "software" are used herein in a generic sense to refer to any type of computer code or set of computer-executable instructions that can be employed to program a computing device or other processor to implement various aspects of the present disclosure as discussed above. Additionally, it should be appreciated that according to one aspect of this embodiment, one or more computer programs that when executed perform methods of the present disclosure need not reside on a single computing device or processor, but may be distributed in a modular fashion amongst a number of different computing devices or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

While the present teachings have been described in conjunction with various embodiments and examples, it is not intended that the present teachings be limited to such embodiments or examples. Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. Accordingly, the foregoing description and drawings are by way of example only.

What is claimed is:

1. A lock system comprising:

a lock unit comprising:

a lock movable between a locked position and an unlocked position;

an actuator coupled to the lock to move the lock between the locked position and the unlocked position;

a sound receiver associated with the actuator, wherein power to the actuator is activated when the sound receiver detects a predetermined sound;

a controller operatively coupled to the actuator and the sound receiver, wherein power to the controller is activated after the sound receiver detects the predetermined sound; and a wireless communicator operatively coupled with the controller, wherein power to the wireless communicator is activated after the sound receiver detects the predetermined sound to allow receive a lock or unlock command sent to the wireless communicator.

2. The lock system of claim 1, wherein the predetermined sound is at least one of a subsonic sound and an ultrasonic sound.

3. The lock system of claim 1, wherein the sound receiver includes a piezoelectric microphone.

4. The lock system of claim 1, wherein the controller operates the actuator to move the lock from the locked position to the unlocked position after the controller receives an unlock signal from the wireless communicator.

5. The lock system of claim 1, wherein the controller operates the actuator to move the lock from the unlocked position to the locked position after the controller receives a lock signal from the wireless communicator.

6. The lock system of claim 1, wherein the predetermined sound includes a predetermined sequence of sounds.

7. The lock system of claim 6, wherein the predetermined sequence of sounds includes one or more sound pulses.

8. The lock system of claim 7, wherein the one or more sound pulses comprise at least two sound pulses with different magnitudes, durations, and/or frequencies.

9. The lock system of claim 7, wherein a signal is encoded in the one or more sound pulses.

10. A lock system comprising:

a lock unit comprising:

a lock moveable between a locked position and an unlocked position;

an actuator coupled to the lock to move the lock between the locked position and the unlocked position;

a sound receiver;

a first wireless communicator; and a lock unit controller operatively coupled with the actuator, sound receiver, and first wireless communicator; and a base station spaced from the lock unit, the base station comprising:

a sound transmitter;

a second wireless communicator; and a base station controller operatively coupled with the sound transmitter and second wireless communicator;

wherein the base station controller is configured to actuate the sound transmitter to transmit a predetermined activation sound and wherein the sound receiver is configured to detect the predetermined activation sound transmitted from the sound transmitter on the base station; and wherein, based on the detected predetermined activation sound, power to the lock unit controller and first wireless communicator is activated to allow communication of a lock or unlock command between the first and second wireless communicators.

11. The lock system of claim 10, wherein, based on the detected predetermined activation sound, power to the actuator is activated.

12. The lock system of claim 11, wherein the lock unit controller operates the actuator to move the lock from the locked position to the unlocked position after an unlock signal is received by the first wireless communicator.

13. The lock system of claim 11, wherein the lock unit controller operates the actuator to move the lock from the unlocked position to the locked position after the lock unit controller receives a lock signal from the first wireless communicator.

14. The lock system of claim 10, wherein the first and second wireless communicators communicate with each other via at least one of a radio frequency (RF), Bluetooth, and Wi-Fi wireless communication protocol.

15. The lock system of claim 10, wherein the sound receiver includes a piezoelectric microphone.

16. The lock system of claim 10, wherein the predetermined sound is at least one of a subsonic sound and an ultrasonic sound.

17. The lock system of claim 16, wherein the predetermined sound includes one or more sound pulses.

18. The lock system of claim 17, wherein the one or more sound pulses comprise at least two sound pulses with different magnitudes, durations, and/or frequencies.

19. The lock system of claim 17, wherein a signal is encoded in the one or more sound pulses.

20. The lock system of claim 10, wherein the base station further comprises a user input system operatively connected to the base station controller.

21. The lock system of claim 20, wherein the user input system includes at least one of a keypad, a touchpad, a biometric scanner, and a radio frequency identification (RFID) reader.

* * * * *